United States Patent [19]

Maxwell

[11] Patent Number: 4,480,362

[45] Date of Patent: Nov. 6, 1984

[54] PROCESS AND MACHINE FOR FABRIC TREATMENT

[75] Inventor: Gordon W. Maxwell, Kilburn, England

[73] Assignee: Courtaulds Limited, London, England

[21] Appl. No.: 337,395

[22] Filed: Jan. 6, 1982

Related U.S. Application Data

[63] Continuation of Ser. No. 152,632, May 23, 1980, abandoned.

[30] Foreign Application Priority Data

May 24, 1979 [GB] United Kingdom ..... 7918172

[51] Int. Cl.[3] ..... D06C 11/00

[52] U.S. Cl. ..... 26/28; 51/334; 51/400; 51/401

[58] Field of Search ..... 26/28; 51/334, 400, 51/401, 402, 404, 407

[56] References Cited

U.S. PATENT DOCUMENTS

| | | | |
|---|---|---|---|
| 394,747 | 12/1888 | Wolcott | 26/28 |
| 1,908,422 | 5/1933 | Heyn | 26/28 |
| 2,617,170 | 11/1952 | Mulholland | 26/28 |
| 3,068,544 | 12/1962 | Connell et al. | 26/28 |
| 3,638,464 | 2/1972 | Winter et al. | 51/334 X |
| 3,706,167 | 12/1972 | Schaffner | 51/334 |
| 3,894,318 | 7/1975 | Ito et al. | 26/28 |
| 4,012,815 | 3/1977 | Benzaquen | 26/28 |

FOREIGN PATENT DOCUMENTS

| | | |
|---|---|---|
| 224201 | 2/1925 | United Kingdom . |
| 504978 | 5/1939 | United Kingdom . |
| 647589 | 12/1950 | United Kingdom . |
| 837103 | 6/1960 | United Kingdom . |
| 873991 | 8/1961 | United Kingdom . |
| 894323 | 4/1962 | United Kingdom . |

OTHER PUBLICATIONS

Research Disclosure 18638 Fabric Abrading Process and Machine for Producing Raised Pile and Suede Effects, Oct. 1979, No. 186.

*Primary Examiner*—Robert Mackey

*Attorney, Agent, or Firm*—Davis Hoxie Faithfull & Hapgood

[57] ABSTRACT

A fabric abrasion process comprises forwarding fabric along a path which brings a surface of the fabric in contact with a yieldable abrading element, for example, a roller, comprising abrasive particles supported by a yieldable body. Pressure is exerted on the fabric to urge it against the yieldable abrading element and cause a depression therein, thereby producing a pile on said surface of the fabric as the fabric passes over the abrading element. A machine for carrying out the process is also described.

6 Claims, 8 Drawing Figures

PROCESS AND MACHINE FOR FABRIC TREATMENT

Figure 1:
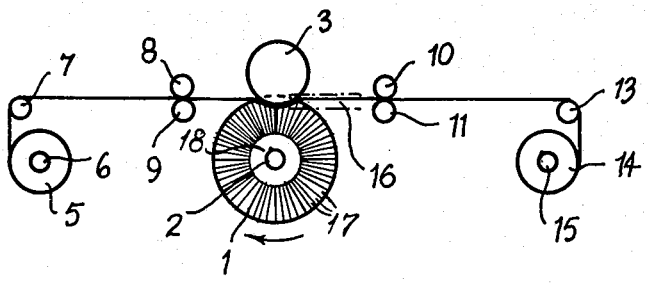

This is a continuation of application Ser. No. 152,632 filed May 23, 1980 and now abandoned.

This invention relates to abrasion of a fabric surface to produce a pile thereon. Conventionally, fabric to be abraded is passed over the surface of a rigid cylinder which is wrapped with emery cloth and engages a free length of fabric extending under tension between two rollers. A machine operating on this principle will normally include a number of abrasive cylinders wrapped with emery cloth.

Alternatively, abrasion may be carried out by using a pressure roller to press moving fabric against an emery cloth supported by being wound on the surface of a further, rigid cylinder.

Abrading fabric is a difficult procedure to carry out economically to a consistently high quality and small variations in the process parameters can sometimes lead to undesirable results. Increase of pressure to too high a value can result in complete destruction of the fabric.

The present invention is concerned with an improvement in the conventional techniques for fabric abrasion which renders the choice of process parameters, particularly the abrasion pressure, less critical than was previously the case and which allows higher pressures to be used than in conventional abrasion techniques, thus, in many cases, enabling the desired end result to be achieved using a smaller number of passes through the abrasion machine than previously. Often a satisfactory pile can be achieved by means of the present invention using only a single pass through a machine with a single abrasive element whereas with conventional techniques this is seldom the case and sometimes satisfactory results were only obtainable, in the past, by combined use of raising, cropping and abrading techniques.

A fabric abrasion process according to the present invention comprises forwarding fabric along a path which brings a surface thereof into contact with a yieldable abrading element, comprising abrasive particles supported by a yieldable body, exerting pressure on the fabric to urge it against said abrading element and cause a depression therein, and thereby producing a pile on said surface of the fabric as the fabric passes over the abrading element.

According to a further aspect of the invention, a fabric abrading machine comprises a yieldable abrading element, comprising abrasive particles supported by a yieldable body, means for forwarding fabric along a path which brings a surface thereof into contact with said abrading element, and means for exerting pressure on fabric following said path to urge the fabric against said abrading element and thereby cause a depression in said element.

The abrading element may be a yieldable three-dimensional abrading element, by which is meant an abrasive element which is yieldable and has abrasive matter distributed not merely on a surface, as in emery cloth, but in the body of the element. One form of abrading element which may be used is a roller comprising a non-woven open skeletal network of fibrous members, the network incorporating abrasive particles. The fibrous members may be of a springy nature and be bonded together by an adhesive and the abrasive grains may be bonded to the fibrous members by an adhesive.

The mean pressure applied by the means for exerting pressure on the fabric, which means may be constituted by a rigid element, for example a cylinder, non-rotatably mounted and urged towards the roller, may be in the region of 8 kPa or possibly higher.

The grain size of the abrasive particles may be within the range of 80 to 180 or sometimes advantageously within the range 100 to 120 on the particle size scale set up by the Grinding Wheel Institute of America.

Figure 5:
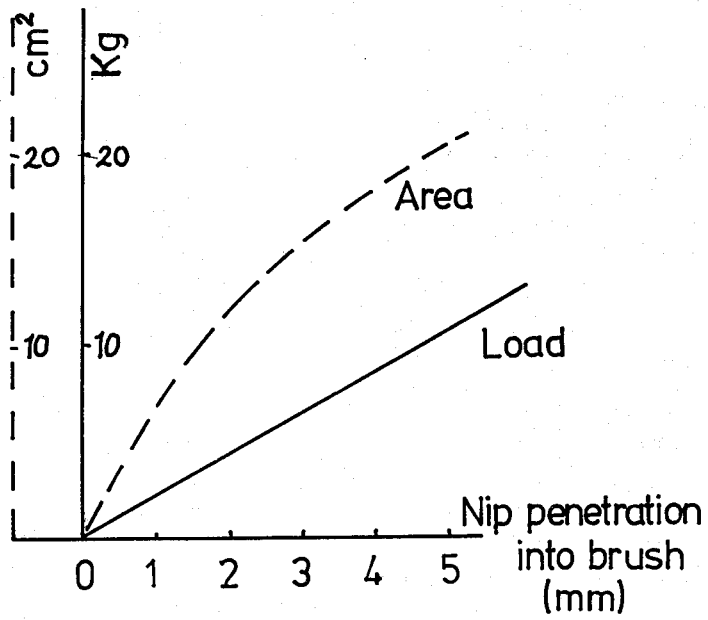
Figure 2:
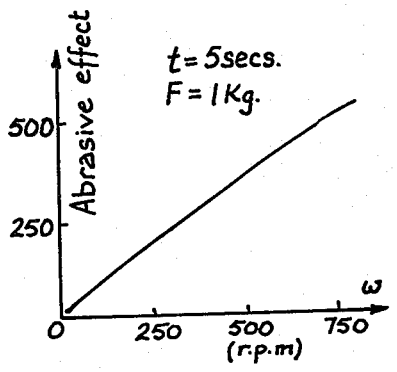
Figure 3:
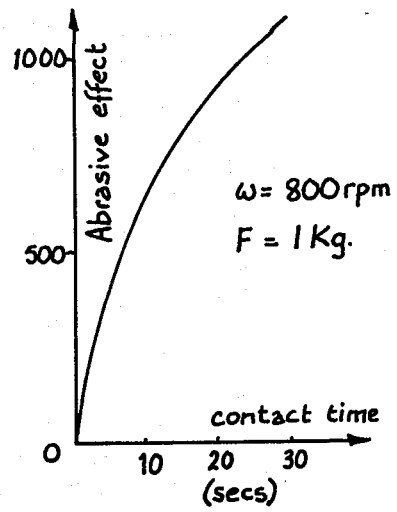
Figure 4:
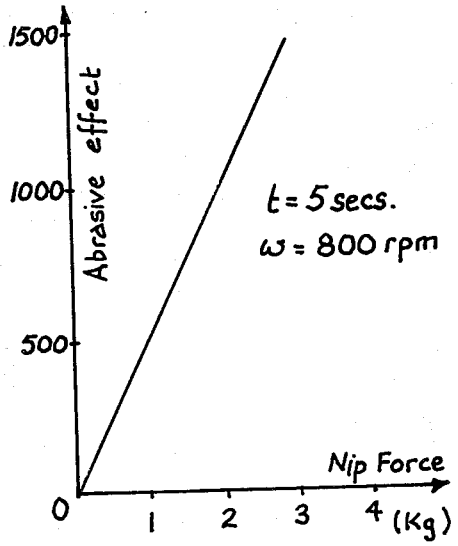
Figure 6:
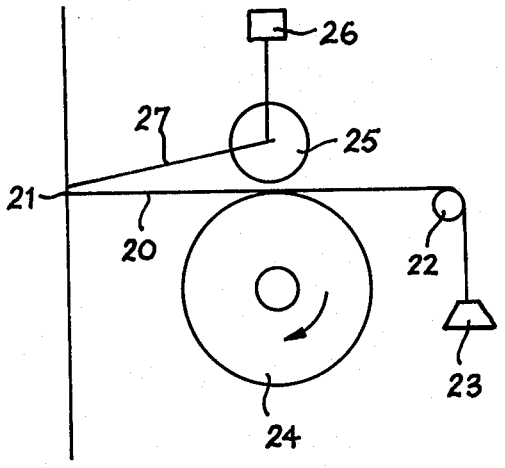

The invention will be further described, by way of example, with reference to the accompanying drawings, in which:

FIG. 1 is a diagram of the main parts of an abrading machine according to the invention, FIGS. 2 to 4 are graphs illustrating the effect of changes in some of the process variables which affect the operation of the machine of FIG. 1, FIG. 5 is a graph illustrating the effect of increasing the load exerted on an abrading element in the machine of FIG. 1, FIG. 6 is a diagram of a test apparatus used to obtain the results represented in the graphs of FIGS. 2 to 4.

Figure 7:
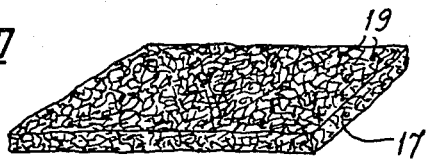
Figure 8:
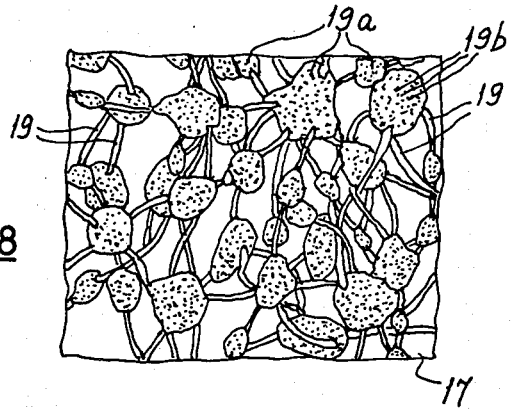

FIG. 7 is a perspective view of one of the abrasive sheets of the abrasive roller employed in the machine of FIG. 1, and FIG. 8 is an enlarged view of part of the sheet of FIG. 7.

The machine illustrated in FIG. 1 comprises an abrasive roller 1 mounted on a shaft 2 and a solid steel cylindrical pressure bar 3 mounted above the roller 1. A roll of fabric 5 to be treated in the machine is mounted on a shaft 6 and the fabric is guided over a roller 7, between nip rollers 8 and 9 and between further nip rollers 10 and 11 along a path which takes the fabric between the abrasive roller 1 and the pressure bar 3 so that the lower surface 12 of the fabric is brought into contact with the periphery of the abrasive roller 1. After passing between the nip rollers 10 and 11, the fabric is guided over a roller 13 to be wound up as a roll 14 on a shaft 15. In use, the nip rollers 8, 9 and 10, 11 are driven so as to forward the fabric 5 at a desired speed under tension. The roller 1 is driven in a clockwise direction at an angular speed such that its abrasive surface moves at a linear speed well in excess of that of the fabric of at least 50 times, and advantageously 100 to 300 times, faster. Alternatively, the roller may be driven in an anti-clockwise direction.

The abrasive roller 1 is constituted by a yieldable abrading element, which may comprise a yieldable body having abrasive particles on its surface, but advantageously is a yieldable three-dimensional abrading element in which abrasive particles are distributed through a yieldable body. The yieldable body in either case may be of synthetic rubber, but preferably has powers of recovering its shape after deformation which are less than those of rubber, so that it recovers more slowly, i.e. is less resilient than rubber.

The roller 1 may comprise a non-woven open skeletal network of resilient springy fibrous members bonded to one another by an adhesive and incorporating abrasive grains bonded to the fibrous members. Examples of materials which may constitute the fibrous members are nylon, polyethylene terephthalate and latex treated cotton threads. Examples of abrasives which may be used are silicon carbide, aluminium oxide and emery. Abrasive particle sizes which may be advantageous are those in the size range 80–180 or possibly 100–120 on the particle size scale set up by The Grinding Wheel Institute of America. Examples of adhesives which may be used are phenolic resins, epoxy resins, polyurethane resins and polyisocyanurate resins. Polystyrene, polyvinyl chloride, polyacrylates and polyamides may also be used as adhesives. Different adhesives may be used to bond the fibrous members together and to bond the abrasive grains to the fibrous members.

Sheets of non-woven material may be combined together to produce the roller 1. For example, a sheet of non-woven material may be spirally wound on a narrow-diameter cylindrical former, the layers thus produced being bonded to one another. Alternatively, annular discs cut from sheets of non-woven material may be mounted side-by-side on a cylindrical former and bonded to one another. In a third alternative, shown in FIG. 1, sheets 17 of non-woven material may be mounted on a cylindrical former so as to lie in planes which intersect at the axis of the cylindrical former and extend radially outward therefrom. The sheets are bonded to one another at the former 18, and FIGS. 7 and 8 are, respectively, a perspective view of an enlarged fragmental view of one of the sheets 17. Referring to these last-mentioned Figures, fibrous members 19 form a non-woven open skeletal network, the fibrous members 19 being bonded together by adhesive globules 19*a* with which are associated abrasive granules 19*b*. A roller of this kind is said to have a flapbrush construction and the term "flapbrush roller" is used in this specification to mean a roller having such a construction. The density of the roller and the nature and quantity of abrasive material distributed through it can be varied depending on the choice of raw materials for the roller 1 and the details of the process used to manufacture it, but each of the three structures for the roller 1 described above results in a roller having a three-dimensional abrasive fibrous network yieldable in three dimensions.

Examples of products made of non-woven materials and useful in practising the present invention are the "Scotchbrite" wheels sold by 3M United Kingdom Limited. "Scotchbrite" is a trade name.

It has been found in trials using abrasive elements comprising rollers made from a non-woven material that if other parameters of the roller are fixed, the degree of abrasion achieved is increased by increasing the density of the roller and by increasing the size of the abrasive particles used, that is by choosing a coarser abrasive. The effect achieved, however, is dependent upon the nature and construction of the fabric being processed. In general, the use of yarns with a greater filament decitex in a fabric, reduces abrasion.

The effect of altering other process parameters has been investigated using a static rig shown diagrammatically in FIG. 6. The parameters investigated include: the speed of rotation of the abrasive roller, the speed of the fabric, which alters the time for which the fabric is in contact with the roller, and the load applied. The results of variations in the parameters investigated are shown in the graphs of FIGS. 2, 3 and 4. A flapbrush roller was used throughout these tests.

In the apparatus of FIG. 6, fabric 20 is anchored at 21 and is supported by a guide bar 22 and loaded at 23. A yieldable three-dimensional abrading element constituted by a roller 24 is rotated clockwise in the Figure in contact with the fabric which is urged against the roller 24 by a cylindrical pressure bar 25 carrying a load 26 and restrained by a pivoted arm 27.

The abrasive effect was estimated visually by comparing the abrasion achieved with previously abraded standards. Three standards were chosen, viz. the original fabric without abrasion, a medium abrasion and a heavily abraded fabric and values of 0, 500 and 1000 were assigned to these degrees of abrasion. The graphs of FIGS. 2 to 4 illustrate the results obtained with a fabric comprising 100 percent cotton denim but the same pattern of results was obtained with other fabrics.

In FIG. 2, the time for which the fabric is in contact with the roller 24 is maintained constant at 5 seconds and the load acting per 3 cm width of fabric is maintained constant at 1 kg. The same wheel, with the same diameter (22.9 cm) is used throughout the tests and the results show that the abrasive effect is proportional to the speed of the roller 24, shown in FIG. 2 in revolutions per minute (r.p.m.).

In a practical machine, weak fabrics may be processed by a roller 1 (of 22.9 cm diameter) rotating slowly (say 50 r.p.m.) and running the fabric through slowly to achieve a contact time in excess of 5 seconds at high pressure (say a load per 1 cm width in excess of 3 kg). However, a normal range of practical operating speeds for a 22.9 cm diameter roller would be from 500 r.p.m. to 1500 r.p.m. and the contact time would be much shorter, normally less than 0.5 seconds. Nevertheless, it is believed that the results depicted in FIGS. 2 to 4 can be extrapolated to the conditions in a practical abrading machine.

The relationship between the time for which the fabric is in contact with the roller 1 and the abrasive effect is shown in the graph of FIG. 3, where the roller speed is maintained constant at 800 r.p.m. and the load per 3 cm width of roller is maintained constant at 1 kg. Thus, the contact time is altered by altering the fabric speed.

FIG. 4 illustrates the effect of changes in the load applied to the fabric in the nip between the bar 25 and the roller 24. The roller speed is maintained at 800 r.p.m. and the contact time at 5 seconds. The abrasive effect achieved is propotional to the nip load.

The nip penetration, that is the depth of the depression created in the roller 1 by the bar 3, indicated by the distance 16 in FIG. 1, (or by the bar 25 in the roller 24) is the result of the interaction of complex variables. In the tests which produced the results illustrated in FIGS. 2 to 4, using a flapbrush roller 24, the nip penetration is the result of a rigid cylinder forced into a rotating yieldable cylinder, having a density which increases as a result of compression, the density in any case decreasing with increasing radius because of the nature of the construction of the roller. Over the range of practical penetrations, FIG. 5 shows that the nip penetration is approximately proportional to the total load applied (or to the load per unit length of contact parallel to the roller axis). However, as load is increased, the rate of increase of contact area falls off. A simplified theory of abrasion under the conditions described can be developed as follows and although based on the "static" measurement obtained with the apparatus of FIG. 6, it is believed to provide a guide for operations under practical conditions such as obtained in the machine of FIG. 1.

Abrasive effect $\alpha$ $f(V_{roller}, F, t)$, or, if we assume that the dependence of the abrasive effect on each variable follows a linear relationship, Abrasive effect $= A.V_{roller}.F.t$ where A = a constant representing the degree of "aggression" of the roller.

$V_{roller}$=surface speed of the roller=$\omega\pi d$.
$\omega$=angular speed of the roller.
d=diameter of the roller.
F=effective load acting across unit width of the width of the fabric.
(i.e. F=effective pressure P x contact length l in the nip (measured around the roller)).
t=contact time in the nip.
(i.e. t=l÷fabric speed V).

$$\text{Therefore the abrasive effect} = A \cdot \omega\pi d \cdot P \cdot l \cdot \frac{l}{V} = A' \cdot \frac{\omega}{V} \cdot P \cdot l^2$$

where A' is a modified constant.

The nip penetrations used in practice in a machine such as that of FIG. 1 may be in the range of 1 to 6 mm with mean nip pressures perhaps in the region of 8 kPa. The yieldability of the abrasive element in the present invention has the important effect of limiting the rate of rise of pressure applied with initial increase in penetration.

In an abrading machine as illustrated in FIG. 1, actual contact times will be of the order of 0.01 second to 0.5 second and the machine will act to cause abrasion of yarn (and even fibrillation in polyester fibers) in both the warp and the weft of woven fabrics and on yarn arranged in both the wale and course directions in knitted fabric. The effects achieved may be similar to those achieved by conventional pile forming machines such as raising, cropping or sueding machines. In some cases, a combination of conventional techniques is needed to produce a comparable effect.

The width reduction normally associated with raising of fabrics using conventional techniques is reduced, and by considerable amounts in the case of most fabric constructions, when using the abrading machine in FIG. 1. In many cases, a single pass through the machine of FIG. 1 will suffice to produce a result achieved only by several passes through a conventional pile forming machine. The yieldability of the abrading element in the machine of FIG. 1 renders the regulation of the load applied to the fabric much less critical than the load applied in a conventional abrading machine where use of too high a load is much more likely to cause damage to the fabric than in the machine of FIG. 1.

Fabric speeds in a machine according to FIG. 1 in which the abrasive roller can achieve surface speeds of 1500 m/min may be in the region of 15 m/min. Higher speeds can be achieved in machines having abrasive rollers capable of higher surface speeds. Commonly, fabric speeds in a machine according to FIG. 1 will be 5 m/min or higher.

One advantage of abrading using a three-dimensional abrading element is that the character of the abrading does not change substantially as the element wears away. Using an emery cloth abrasive, for example, the effect achieved alters as the surface of the cloth becomes worn.

The conventional fabric abrasion techniques using emery cloth wound on a rigid cylinder appear from electron micrographs to have the effect of a plucking-cutting action on the yarn filaments in the fabric, that is, they appear to act by catching hold of individual filaments and stretching them to breaking point. This is consistent with a major proportion of the effect resulting in damage to weft filaments (assuming the fabric is run through the abrasion machine in the warp direction).

Use of an abrasive element constituted by a flapbrush roller appears, however, on electron micrographs to produce its effect predominantly by pure abrasion of the surface of individual filaments and this is consistent with damage to the surface of both warp and weft filaments in similar proportions.

This explanation is also consistent with the lower reduction in width of fabric under treatment in the present process compared with conventional techniques. A plucking action would be expected to draw loops in the fabric tight and draw the fabric in. Pure abrasion, even if carried to the extent of severing filaments will not have the same effect. Hence, the type of fabric manufactured for treatment by conventional abrasion techniques may not be best suited for treatment by the present process. In the process of the present invention, a fabric which is stable as first manufactured without being treated so as to cause it to contract widthwise, may be more desirable.

What I claim is:

1. A fabric abrading machine for raising a pile predominantly by pure abrasion on the surface of a fabric, said machine including:

(a) an abrading roller consisting essentially of a solid, wholly coherent body of a yieldable non-woven, three dimension, skeletal network incorporating abrasive particles distributed throughout said body;

(b) a rigid pressure element arranged in nip relationship with said abrading roller;

(c) means mounting said abrading roller and said pressure element whereby said pressure element is able to press into and cause a depression in said abrading roller body having a depth at least in the region of from 1 to 6 mm;

(d) means for forwarding fabric along a path through said nip between the abrading roller and said pressure element and in contact with the surface of said abrading roller body; and (e) means for rotating said abrading roller body at a speed such that the surface speed of the abrading roller is substantially greater than the forwarding speed of the fabric.

2. The fabric abrading machine according to claim 1 wherein the abrading roller comprises a plurality of sheets of non-woven fibrous material, each incorporating abrasive particles distributed throughout, laminated together to form a coherent, yieldable body.

3. A fabric abrading machine according to claim 1 wherein said mounting means are adapted to produce a mean pressure of at least 8 kPa between said pressure element and the abrading roller body.

4. A fabric abrading machine according to claim 1 or 3 wherein the grain size of said abrasive particles is within the range 80 to 180 on the grain size scale of the Grinding Wheel Institute of America.

5. A method of abrading a fabric surface predominantly by pure abrasion to produce a pile thereon, said method comprising the steps of:

(a) forwarding a fabric along a path which brings a surface thereof in contact with the surface of an abrasive roller consisting essentially of a yieldable solid, coherent body of a non-woven three dimensional skeletal network incorporating abrasive particles distributed through said network, (b) exerting pressure on the fabric by means of a rigid pressure element in nip relationship with said abrading roller so that said rigid pressure element causes a depression in said abrading roller body having a depth at least in the region of from 1 to 6 mm and presses the fabric against the abrading roller body in said depression, and (c) rotating said abrading roller at a speed such that the surface speed of the abrading roller is substantially greater than the speed of the fabric.

6. A method of abrading a fabric surface according to claim 5 wherein the fabric is urged into said abrading roller body with a mean pressure of at least 8 kPa.

* * * * *